United States Patent [19]

Eisenberg

[11] 4,253,252

[45] Mar. 3, 1981

[54] SKI BOOT

[76] Inventor: Joel H. Eisenberg, 53A Blackhawk La., Stratford, Conn. 06497

[21] Appl. No.: 20,512

[22] Filed: Mar. 14, 1979

[51] Int. Cl.[3] ..... A43B 5/04; A43B 7/14; A43B 13/18

[52] U.S. Cl. ..... 36/120; 36/28; 36/96

[58] Field of Search ..... 36/117, 36/119, 120, 102, 114, 28; 272/96

[56] References Cited

U.S. PATENT DOCUMENTS

| | | | |
|---|---|---|---|
| 886,801 | 5/1908 | Harmon | 36/28 |
| 1,380,879 | 6/1921 | Young | 36/28 |
| 3,067,531 | 12/1962 | Scott et al. | 36/120 |
| 3,303,584 | 2/1967 | Werner et al. | 36/120 |
| 3,775,875 | 12/1973 | Dvorsky | 36/117 |
| 4,074,446 | 2/1978 | Eisenberg | 36/120 |
| 4,144,659 | 3/1979 | Eisenberg | 36/120 |

FOREIGN PATENT DOCUMENTS

| | | | |
|---|---|---|---|
| 1058944 | 11/1953 | France | 272/96 |
| 103541 | 1/1964 | Norway | 272/96 |

*Primary Examiner*—Patrick D. Lawson

[57] ABSTRACT

A ski boot comprising an outer boot having a sole on which an improved foot supporting insert rests, the insert including a footbed supported by a rear heel balance post, a central metatarsal balance pad and a forward toe balance pad, the insert forming and holding the foot of a skier in a functional cavus or high-arched foot positon when a foot is placed thereon and being laterally tiltable relative to the sole within the boot upon inversion or eversion of the foot thereby creating a weight shift which is transferred to a lateral edge of a ski attached to the boot causing the ski to turn.

41 Claims, 18 Drawing Figures

SKI BOOT

BACKGROUND OF THE INVENTION

This invention primarily relates to an improvement in ski boots, particularly in regard to the manner in which the ski boot functions with respect to the foot and the leg of the skier in turning or maneuvering. It constitutes an improvement on the ski boot inventions disclosed and claimed in my U.S. Pat. No. 4,074,446, issued Feb. 21, 1978, and my copending application Ser. No. 875,178 filed Feb. 6, 1978, now U.S. Pat. No. 4,144,659, particularly in the means for supporting the feet in the boots, to provide comfortable, functionally superior ski boots.

In skiing, the skier turns by shifting his weight so that it is temporarily transferred to either the inside or the outside edges of his skis. This causes an unbalanced effect on the skis, and they turn in the direction of the weighted edges. In short, it is this weighting and corresponding unweighting of the sides of the skis which permits the skier to maneuver as he skis down a hill.

In the art prior to my inventions, the ski boot is locked to the ski by the binding and the ski boot cannot move in any direction without producing a corresponding movement in the ski. As the foot and the ankle of the skier are firmly and substantially immovably held in the prior art ski boot so that movement of the skier's foot without moving his leg is not possible, the skier turns by twisting his entire torso. The knees of the skier are laterally moved in the direction of the turn, bending his lower legs outwardly causing the boot to tilt and thereby shifting weight to the edge of the ski as required. Unfortunately, this lateral movement of the knee tends to turn the foot itself and the ski in the opposite direction against the turn. As a result, the skier expends a substantial amount of energy in turning and experiences a substantial strain particularly with respect to the knees and proximal joints. Furthermore, as a result of this arrangement the ski boots in the art prior to my inventions must be fabricated so that the sidewalls are strong enough to lock the ankle and foot in place, but at the same time the skier must be able to bend his leg laterally in order to turn, which causes additional stress proximally.

These prior art ski boots, therefore, do not take advantage of the foot's natural lateral tilting movement, which is known as inversion and eversion. In terms of bone structure, the foot has a subtalar joint, formed by the talus and the os calcis which is responsible for most of the lateral movement of the foot. Because of this subtalar joint, the foot can be tilted without moving the remainder of the leg to the extent required by prior art ski boots, and it is, therefore, possible to shift the weight of the body just by inverting or everting the foot with substantially less moving of the knees or twisting of the torso. However, the subtalar motion, or inversion and eversion of the foot, cannot exist if the ankle and the foot are held in place, as they usually are in prior art ski boots, some of which are even form fitted to the individual's feet.

Accordingly, the prior art ski boot design is unsatisfactory from a number of standpoints, particularly since it does not permit the skier to turn easily without a great expenditure of energy and stress on various parts of the body, such as the knees and torso.

SUMMARY OF THE INVENTION

The foregoing background is common and relevant to the inventions of my referred-to patent and copending application and the invention of this application, and equally applicable. In my U.S. Pat. No. 4,074,446, an improvement for ski boots was provided which comprised means whereby the natural inversion and eversion of the foot can be employed by itself to shift the weight of a skier thereby turning the skis. The invention generally comprised a ski boot at least a portion of which is laterally tiltable with respect to the ski along the longitudinal axis by merely inverting and everting the foot. The skier can, therefore, shift his weight with relation to the edge of the skis and turn simply by a slight foot movement.

In one embodiment of the invention of my said patent, a tiltable insert is used in an existing ski boot. The insert comprises a plate having a balancing point on its bottom which is inserted into a ski boot so that it balances on the inside sole of the boot. The plate is free to laterally tilt inside the ski boot which is secured to the ski in the usual manner. The foot of the skier, which is movable in the ski boot, rests upon the top of the plate. The skier can shift his weight by tilting his foot inside the boot which causes a corresponding tilt in the insert. This weight shift is transmitted to the edge of the skis while the boot and ski remain level.

Although the invention of my said patent is entirely satisfactory for its intended purposes, the invention of my copending application, now U.S. Pat. No. 4,144,659, deals with an improvement in ski boots centering about a unique insert which is designed and operates so as to enhance its functioning, materially improve its comfort and render it readily manufacturable at a low cost. The improved insert can be incorporated into a specially designed boot or added to an already existing ski boot. The tilting of the foot causes a corresponding tilting of the insert and a weight shift to the edge of the ski resulting in the skis turning with substantially less corresponding twisting, straining and lateral movement of the knees and torso of the skier. The insert can be incorporated into other ice sports shoes, such as ice skates and cross-country ski boots.

Although the invention of my copending application, now U.S. Pat. No. 4,144,659, is entirely satisfactory for its intended purposes, the present invention deals with an improvement in the insert which further enhances its functioning and further improves its comfort.

Accordingly, it is a principal object of this invention to provide an improved ski boot wherein the weight shift to the edge of the skis is accomplished by movement of the feet, i.e. inversion and eversion, instead of substantial lateral movement of the knees and twisting of the torso and, wherein, greater control and comfort is afforded the skier.

Another object of the present invention is to provide an improved insert which functions in an improved manner to provide a functional cavus foot and is materially more comfortable in use.

Other and more specific objects of the invention will be in part obvious and will in part appear from the following description of the preferred embodiments and claims taken together with the drawings.

BRIEF DESCRIPTION OF THE DRAWINGS

The same reference numbers refer to the same elements throughout the various Figures.

DESCRIPTION OF THE PREFERRED EMBODIMENTS

Referring now to FIGS. 1–12, a first embodiment 10 of a ski boot according to the invention is shown. The ski boot 10 generally comprises two main elements which are an outer boot 12 and a movable insert 30.

Figure 1:
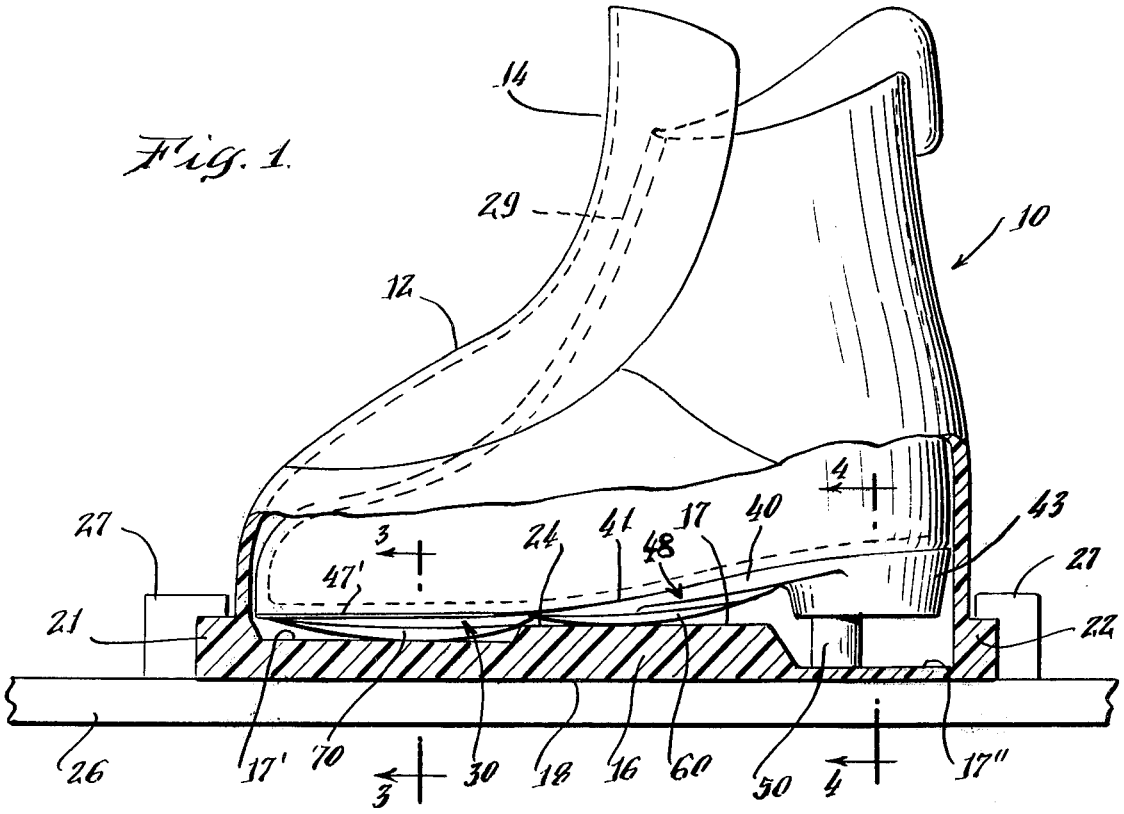
FIG. 1 is a side elevational view of a ski boot according to the invention herein for the left foot of a skier with the lower portion cut away and showing the improved insert in position prior to being mounted on the left foot of a skier.

As shown in FIG. 1, the outer boot 12 generally comprises an upper shell 14 which is substantially inflexible and secured to a boot sole 16. The illustrated outer boot 12 is one type of boot into which my inventive insert may be incorporated to provide an improved ski boot; however, it should be understood that my invention may be incorporated into other types of outer boots. The boot sole 16 is substantially foot shaped and of considerable thickness. The boot sole 16 has a top surface 17 and a bottom surface 18. As shown in FIG. 1, a small portion of the sole 16 extends beyond each end of the upper shell 14 forming a front lip 21 and a rear lip 22. The remaining portion of the top surface 17 of the sole 16 which is disposed inside the upper shell 14 comprises the inside base 24 of the outer boot 12 and has a forward well 17′ and rearward well 17″.

The outer boot 12 is fixed to a ski 26, only a portion of which is shown in FIG. 1, by means of a pair of bindings 27 which are secured to the ski 26. When the outer boot 12 is in place on the ski 26, the bottom surface 18 of the sole 16 rests upon the ski 26, as shown in FIG. 1. The bindings 27 are selectively attached to the front lip 21 and the rear lip 22 of the outer boot 12 thereby holding the outer boot 12 to the ski 26 unless the bindings 27 are released. The detailed construction of the bindings and skis form no specific part of my invention. When the outer boot 12 is in place, the outer boot 12 cannot move independently of the ski 26. An insulated inner boot 29 fits inside the upper shell 14 of the outer boot 12. In the prior art ski boots prior to my inventions, the insulated boot 29 would usually rest directly upon a base covering the sole 16 and be immovable inside the outer boot 12. The insulated inner boot 29 of my invention, however, rests on the insert 30 and its lower portion is selectively laterally movable inside the upper shell 14 of the outer boot 12; these parts are so configured and dimensioned to permit such movement.

As shown in FIG. 1, an insert 30 is disposed in the outer boot 12 between the sole 16 and the inner insulated boot 29. The insert 30 can best be seen by itself in FIGS. 9–12, and generally comprises a footbed 40, a rear heel area balance post 50, a central metatarsal area balance pad 60 and a forward toe area balance pad 70. As operatively disposed in FIG. 1, without a foot in the ski boot, the pad 70 is disposed in well 17′, pad 60 rests on or above surface 17, and post 50 is disposed in well 17″.

Footbed 40 is generally foot-shaped and plate-like, and has an upper surface 41, which may be roughened to prevent sliding of the sole of the inner boot, and, a lower surface 42. A hollow heel 43 and a hollow cylinder 44 configured to receive post 50 are formed at the rear lower surface 42 of footbed 40 integrally therewith at the heel area. The cylinder 44 is located at the lateral outboard side of the heel area of the footbed. The post 50 is a solid cylindrical section and fits snugly in cylinder 44. To facilitate mounting of the post, an opening 45 is formed in the footbed to act as an air vent during mounting.

Figure 9:
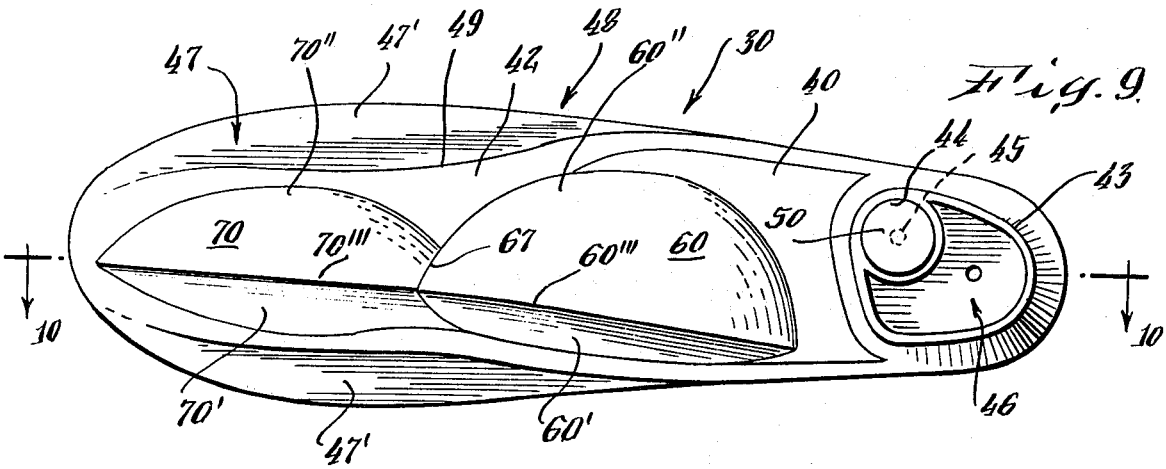
FIG. 9 is a bottom plan view of the insert per se of the invention.
Figure 10:
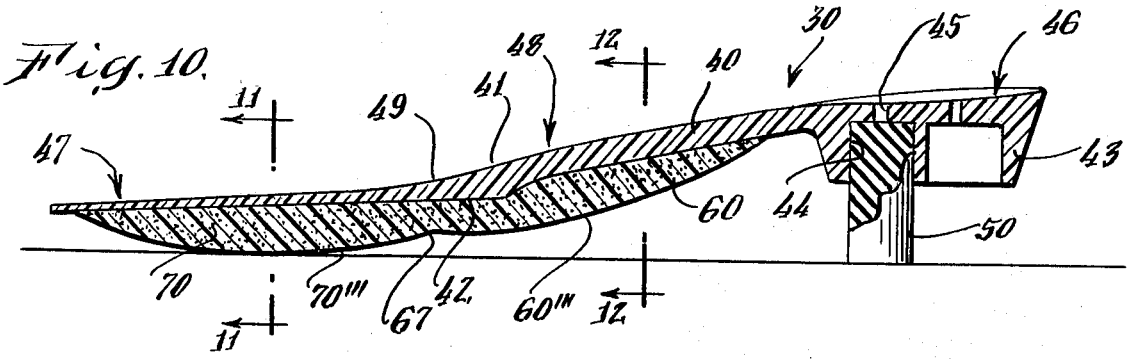
FIG. 10 is a sectional view taken substantially along lines 10—10 of FIG. 9.
Figure 11:
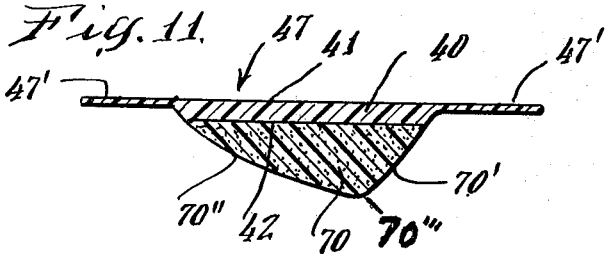
FIG. 11 is a sectional view taken substantially along lines 11—11 of FIG. 10.
Figure 12:
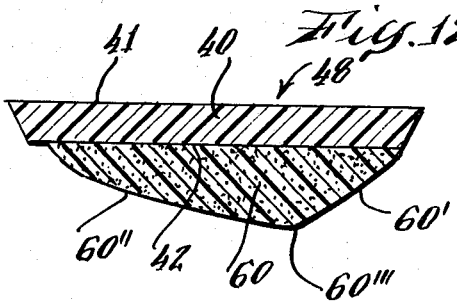
FIG. 12 is a sectional view taken substantially along lines 12—12 of FIG. 10.

When in its unstressed, free state, footbed 40 is configured as illustrated in FIGS. 1 and 9–12. With particular reference to FIG. 10, it will be observed that: the rear section 46 of the footbed (approximate rear third) extends generally horizontally, but is slightly inclined downwardly from rear to front; the forward section 47 of the footbed (approximate front third) similarly extends, but at a lower level than section 46, and the central connecting section 48 (approximate middle third) is slightly arched. The thickness of the footbed differs longitudinally in that the approximate rear sixty percent is generally thicker than the front approximate forty percent, and their lateral connecting area 49 is thickest. As can best be seen in FIG. 9, the lateral sides of the forward section 47 are reduced in thickness to form flexible horizontal side stabilizers 47′ which when the insert 30 is in its neutral central position, rest on spaced, side lands 17‴ formed on opposite sides of forward well 17′ of the illustrated ski boot 12 (see FIGS. 3 and 5). Stabilizers 47′ aid in positioning the insert in the illustrated ski boot.

Toe area balance pad 70 is disposed at the underside of the forward end of the footbed 40. Pad 70 depends from the lower side 42 of the footbed at the forward section 47. As can be understood by viewing FIGS. 9–11, it is a solid mound-like formation having a smaller horizontal outline than the outline of the adjacent footbed section; being noncentrally disposed relative to the footbed in that its centerline is offset slightly inboard of the centerline of the footbed, and being complexly curved in that it is nonsymmetrically curved both longitudinally and transversely. Pad 70 has its lower surface formed by two curved side surfaces 70' and 70'', the former being steeper and on the inboard side of the footbed (see FIG. 11).

Metatarsal area balance pad 60 is generally similar to pad 70 but slightly larger in horizontal outline (see FIG. 9). It is formed by nonsymmetrically curved side surfaces 60' and 60'' (see FIG. 12), respectively, generally corresponding to surfaces 70' and 70'' of pad 70. In this regard, surface 60' is steeper than surface 60'' and on the inboard side of the footbed.

The pads 70 and 60 have aligned high ridges 70''' and 60''', formed, respectively, by and at the juncture of their curved side surfaces, which ridges are offset from the centerline of the footbed on the inboard side (see FIG. 9). The aligned ridges extend at an angle rearwardly toward the inboard side of the footbed. The pads 60 and 70 at their adjacent end area 67 are connected, narrowed and of shorter height to form a weakened flexing zone for the footbed that extends laterally at about the zone of juncture of the central section 48 and forward section 47. The pads are secured to the footbed, as by cementing.

Thus far, I have described the parts of the insert 30 primarily in terms of their physical structure, i.e. shape, size. disposition, etc. For optimum operational results, the materials of which the parts of the insert are made are important, particularly in respect to their hardness. In this regard, the insert has been described as comprising three parts, the footbed 40, composite pads 60 and 70, and post 50. As will be subsequently discussed, the insert may be manufactured differently, as by being made of a different number of parts. In general, footbed 40 is preferably made from a moldable plastic material selected so as to be sufficiently stiff as to maintain its unstressed shape illustrated in FIGS. 1, 9 and 10; sufficiently strong as to withstand the operational loads and stresses imposed on it, and sufficiently flexible so as when taken with the configuration of the footbed to be deformable, when mounted in a ski boot and having a skier's foot operationally disposed in the boot, to permit, in fact, facilitate the foot deforming to tend to form a cavus foot disposition, as shown in FIG. 2.

Figure 2:
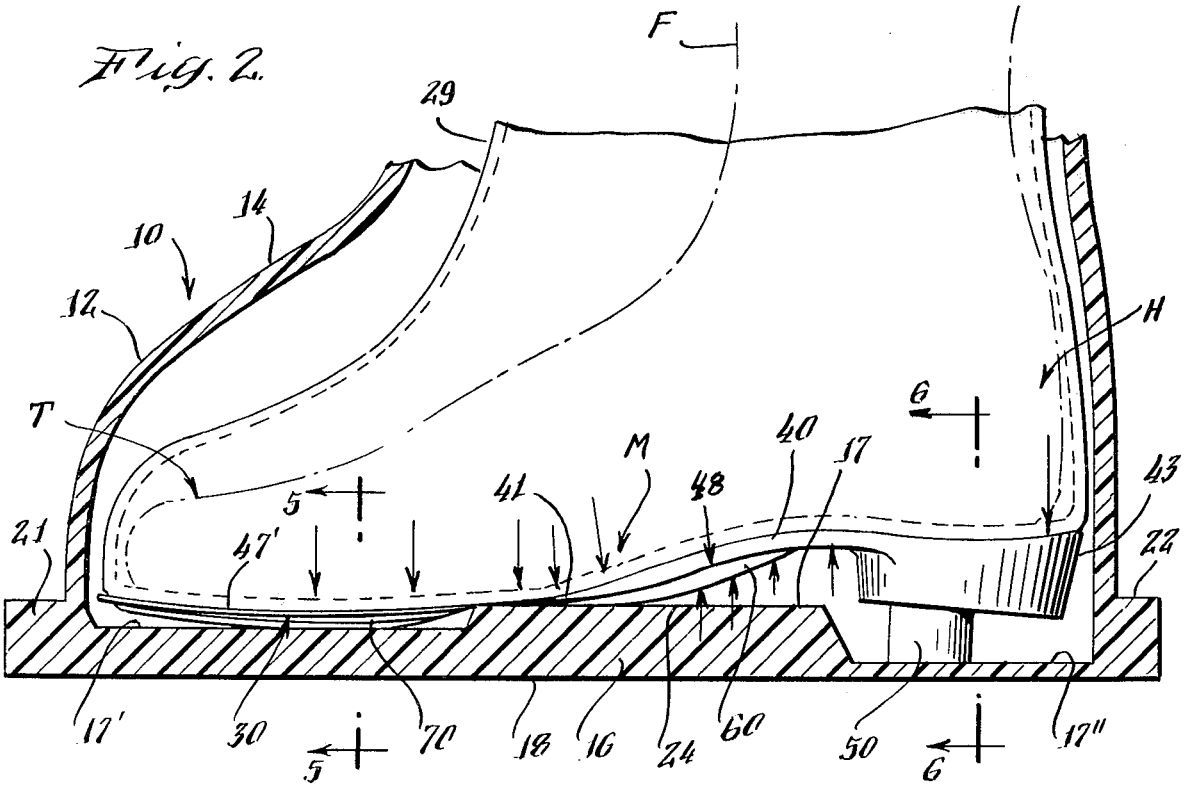
FIG. 2 is a view similar to FIG. 1, but showing the ski boot as disposed when mounted on the left foot of a skier and weight is operative on the insert as when the skier is standing or skiing.
Figure 13:
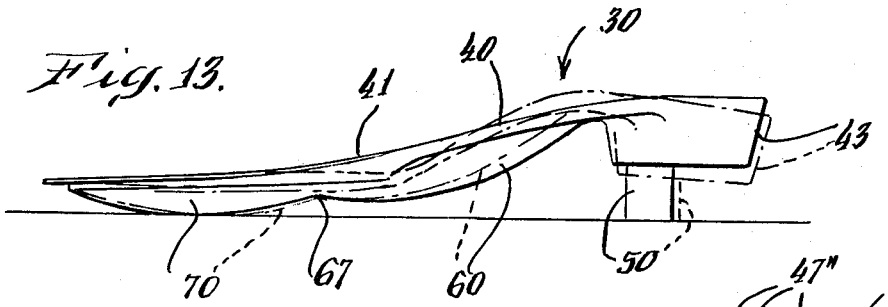
FIG. 13 is a schematic view showing the operation of the insert to produce a functional cavus foot.

A comparison of the dispositions of the insert 30 in its FIGS. 1 and 2 conditions indicates the manner in which the footbed causes the weight of the skier's foot F to force the rear portion of the heel 43 slightly downwardly, arch the forward portion of the heel 43 slightly upwardly, arch the rear portion of the central section 48 upwardly, and depress the forward portion of the central section downwardly, so as to form a footbed shape which disposes the foot in a functional cavus disposition. This is shown schematically in somewhat exaggerated form in FIG. 13, where the unstressed FIG. 1 condition of the insert 30 is shown in solid lines, and the stressed FIG. 2 condition is shown in dot-dash lines. It will be noted that the described deforming of the footbed 40 is accompanied with a shortening of the height of the post 50 and an increase in its diameter. This is allowed by making the post 50 of an appropriately resilient material. The post 50 comprises a solid cylinder that is mounted in the socket formed by the hollow cylinder 44 in any convenient manner, as by a friction fit, cementing or the like. The placing of the skier's weight on the insert 30 has the additional effect of causing the pads 60 and 70, which are made of a material that is softer than that of footbed 40 but harder than that of post 50, to be forced against the inside base 24 of the boot and to be compressed. The metatarsal pad 60 functions as a metatarsal bar under the metatarsal area M of the skier's foot F to relieve pressure on the toe area T and, therefore, usually receives more pressure than toe pad 70. In addition to material selection, the configuration of the footbed 40, i.e. its shape and varying thickness as illustrated and described, and the provision of the pads weakened area 67, facilitates the deformation of the footbed 40 into the desired shape illustrated in FIGS. 2 and 13, which deforms the foot into a functional cavus disposition. In operation, there is flexure of the footbed at various places, such as at the juncture of the front of heel 43 and the adjacent part of the footbed, and the juncture of the front section 47 and central section 48. If desired and appropriate, reinforcements, such as molded-in ribs may be employed at high stress points, such as the juncture of the heel and footbed.

To summarize, in general terms, the hardness relationship of the materials of the described three-part insert 30 is that: footbed 40 is made of a strong flexible plastic material that is hardest, such as a moldable polymer; the pads 60 and 70 are made of a single part and are made of a strong, rather hard, but slightly softer material than the footbed, such as a plastic foam, and the post 50 is made of the softest material, such as a synthetic or natural gum rubber. However, in some use application, some skiers may prefer that the post 50 be as hard or harder than the pads 60 and 70, and such a variation can be provided.

One particular example of specific materials which have proved successful in practice and effectively may be employed is as follows:

1. Footbed 40:
Foamed glass reinforced Surlyn (10% glass; 0.5% blowing agent)
Density: 0.92 gm/ml
Shore D Hardness: 58–63

| Formulation: | Parts by weight |
|---|---|
| Surlyn 1557 | 104 |
| Surlyn 1605 | 200 |
| AD9137 Glass M.B.* | 121.6 |
| Ficel M.B.** | 10.6 |

2. Pads 60 and 70:
Closed cell urethane foam
Density: 0.54 gm/ml
Hardness: 55–60 Shore A

| Formulation: | Parts by weight |
|---|---|
| Reynolds RU-5717-R | 100 |
| Reynolds RU-5717-T | 44 |

3. Post 50:
Low set & creep, non-freezing rubber
Hardness: 43–47 Shore A

| Formulation: | Parts by weight |
|---|---|
| Natural Rubber - SMR5CLV | 60 |
| Cis-Polybutadiene - CB 220 | 40 |
| Zinc Oxide | 5 |
| Stearic Acid | 1 |
| Antioxidant - AO A-555 | 0.5 |
| Santocure | 1.0 |
| DPG | 0.75 |
| Sulfur | 3.0 |
| Acidic Softening Oil - Reogen | 5.0 |

4. Adhesive for securing pads 60 and 70 to footbed 40:

-continued

| |
|---|
| 3M's - EC-880 - Neoprene based contact adhesive. |

*Contains 35% fiberglass in Surlyn 1557
**Contains 20% Ficel blowing agent in EVA.

It should be clearly understood that though the foregoing specific example of materials provides an effective insert, other materials may be substituted, as long as the hardness relationship is maintained, and an insert is provided which will function to be deformable as described and provide a comfortable cushioned support for the skier's feet.

Figure 3:
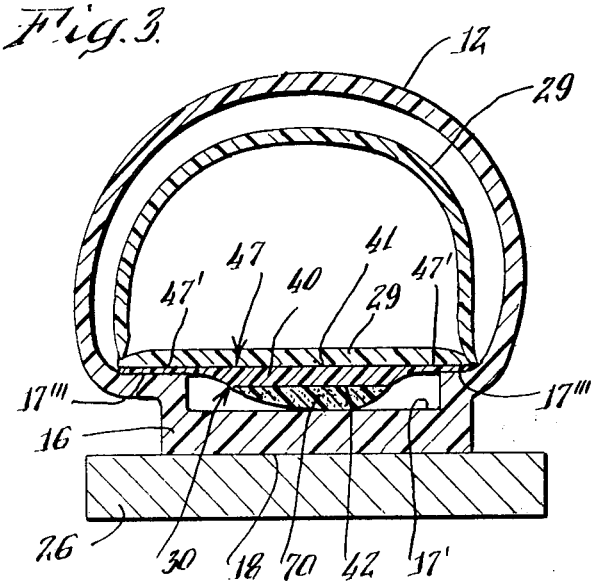
FIG. 3 is a sectional view taken substantially along lines 3—3 of FIG. 1.
Figure 4:
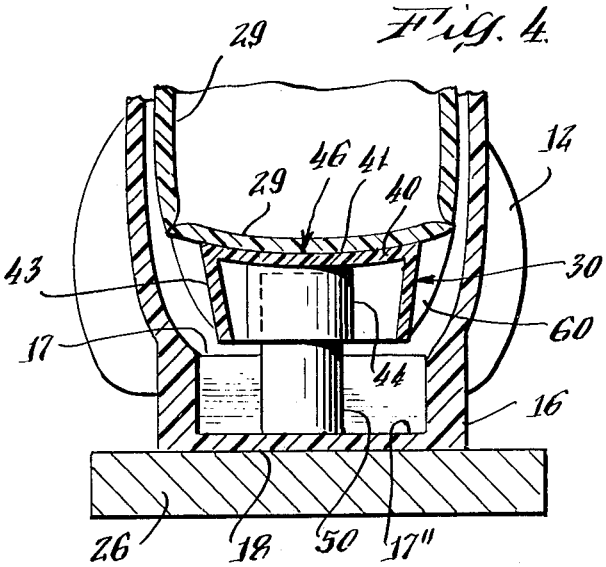
FIG. 4 is a sectional view taken substantially along lines 4—4 of FIG. 1.
Figure 5:
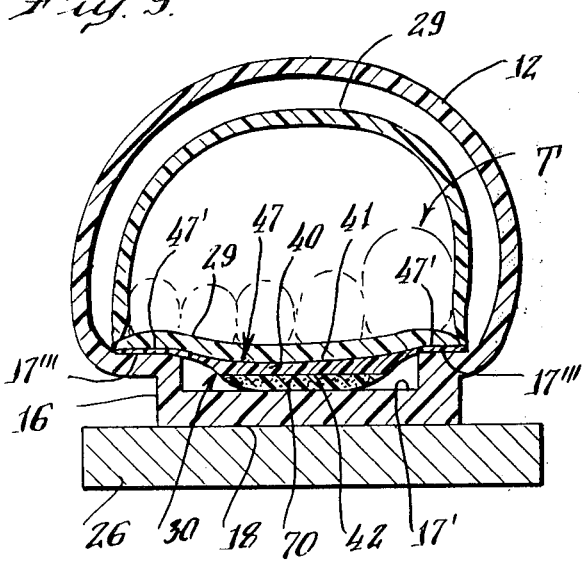
FIG. 5 is a sectional view taken substantially along lines 5—5 of FIG. 2.
Figure 6:
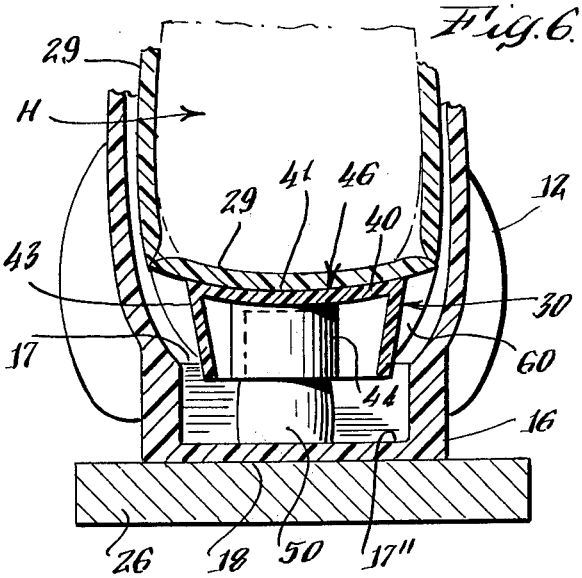
FIG. 6 is a sectional view taken substantially along lines 6—6 of FIG. 2.
Figure 7:
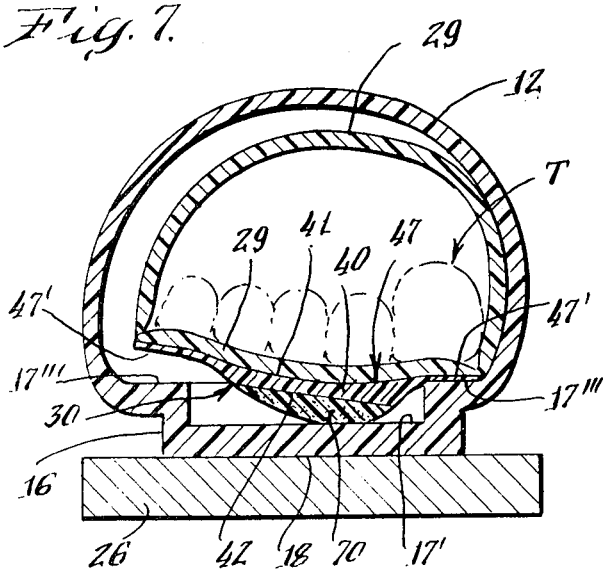
FIG. 7 is a view similar to FIG. 5 showing the disposition of the parts of the ski boot upon eversion of the skier's left foot.
Figure 8:
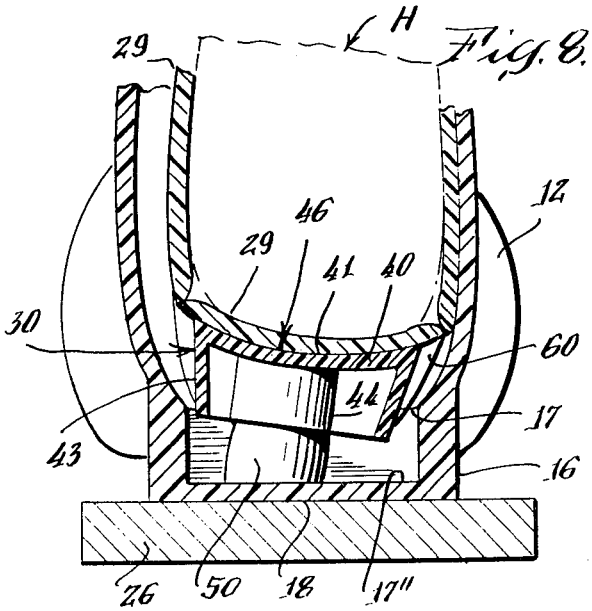
FIG. 8 is a view similar to FIG. 6 showing the disposition of the parts of the ski boot upon eversion of the skier's left foot.

The insert 30 is sized relative to the interior of the ski boot so as to be capable of tilting relative to the outer boot 12 to permit the selective, desired weight shift. As shown in FIGS. 7 and 8, the weight shift is caused by everting the left foot F toward the inboard edge of the boot and ski. When the insert 30 is mounted in the boot without the foot of a skier, as shown in FIGS. 1, 3 and 4: the pad 70 is disposed in the front well 17' and lightly contacts the portion of top surface 17 disposed within the well 17'; the post 50 rests on the portion of the top surface 17 disposed within the rear well 17'; and the pad 60 lightly rests on or is slightly disposed above the portion of the top surface 17 between the two wells. In this condition, the post 50, which is disposed on the outboard side of the footbed, is located at the outboard side of the well 17'' of the illustrated outer boot 12. When the foot of the skier is inserted into the ski boot with weight evenly distributed, i.e. in a neutral condition, the footbed is deformed into the configuration shown in FIGS. 2, 5 and 6. In this condition, the pad 70 is slightly compressed and the post 50 is substantially compressed, respectively, at the toes T area and heel H area. The pad 60 is slightly compressed on surface 17 and enhances the cushioned support of the cavity formed in the foot. In this neutral condition, the horizontal stabilizers 47' rest on the side lands 17'''. In this neutral condition, weight is evenly distributed over the upper surface 41 of the footbed 40; the insert 30 remains in a level or horizontal position with respect to the outer boot 12 and the ski 26, and the weight is operative at the centerline of the ski. In this condition, other things being equal, the skier will move in a straight line.

Shifting of the weight of the skier to one side or the other, as occurs with inversion or eversion of the foot, will cause the insert 30 to tilt in relation to the outer boot 12 and the ski 26, and move the line of weight application toward outer or inner edges of the boot and ski, respectively. In skiing, the inner edges of the skis are primarily used to cause turning and, therefore, when using my improved ski boots, eversion of the feet is primarily employed to turn. In FIGS. 7 and 8, there is illustrated the tilting of the insert 30 resulting from eversion of the foot of the skier. Illustrated throughout the drawings is the left foot of the skier in a left boot and, therefore, the insert has tilted clockwise thereby causing a shift of the weight toward the inboard edge of the ski. This will cause the skier to turn toward the right in down hill skiing. This all has occurred without any substantial movement of the outer boot 12 and, therefore, without substantial lateral movement of the knees or the torso. The functional cavus disposition of the skier's left foot intentionally caused by my ski boot, taken with the slightly inboard and longitudinally angled disposition of the high ridges of the pads 60 and 70, and taken further with the outboard dispostion of the post 50, results in substantial tilting resulting from relatively minor eversion. During this operation, the skier's foot is maintained in a comfortable condition by virtue of the soft cushioning effect of the pads 60 and 70 and the post 50.

It should be understood that eversion of a right foot in one of my right ski boots causes a reverse turn, i.e. toward the left, as a result of the movement of the line of weight application to the inboard side of the right boot and ski. The principle involved is that the ski turns toward the pressure side of the ski.

My invention takes advantage of the natural structure and function of feet. I have ascertained that the best disposition of a skier's feet is that which tends toward a cavus disposition. This permits maximum lateral weight shift with minimum foot movement and effort. My concept affords effortless, sensitive, pressure changes toward the desired ski edge to control turning. It is the natural functioning of the foot which permits subtle, easy control of turning. The skier assumes a natural attitude and feel. Turning is as simple and natural as walking. To turn, the skier simulates a walking sequence. He causes a gradual progression of movement and consequent pressure on the lateral heel area through the foot and insert to the medial toe area. The movement is not abrupt or strained; it is positive, but soft. The footbed 40 tilts toward its inboard side; the post 50 permits such tilting by internal give, compression and distortion, and the pads 60, 70 compress and pivot. Throughout, the skier is more relaxed and comfortable, skis better and more confidently, and is subject to less fatigue. The novice learns more quickly. The intermediate skis more skillfully. The expert skis more expertly.

The freeing up of the previously tightly bound feet and ankles permits better blood circulation, less chilling and, therefore, warmer more comfortable feet.

An additional advantage of my improved ski boot is that it permits some degree of selective fore and aft pitching movement, which permits the skier to adapt to different skiing conditions, such as soft, hard, dry, wet or powdered snow, ice, etc. The resilient floating support of the feet by the heel post and pads permit this selective rocking movement. It will be understood that inserts may be made of different sizes or size ranges for different size boots. Further, to accommodate the tastes of different skiers, the post 50 may be made of varying hardnesses or dimensions to achieve the desired degree of post resilience.

MODIFICATIONS

It should be clearly understood that variations in materials, dimensions and detailed construction may be made without departing from my invention. As mentioned, the size and hardness of the post 50 can be varied to suit the taste of the skier. As a matter of fact, if desired, the post 50 could be hollow or comprise a coil spring. Of course, the hardness of the pads 60 and 70 can likewise be varied. Also, those skilled in the art of manufacturing can vary the configuration-hardness relationships, if desired, e.g. vary resilience of a part by making it larger or of harder material or a combination of both.

As mentioned hereinabove, the illustrated outer boot 12 is only one type of boot into which my invention may be incorporated. In fact, it is one type of existing ski boot of a ski boot manufacturer who has licensed my invention. It includes the disclosed wells 17' and 17''. Of course, my invention may be incorporated into other types of ski boots, such as those having flat inside bases. In this event, it is obvious that the dimension of the insert would have to be changed to "fit" the boot, and particularly, the absence of the wells would require changes in the size of the pads 60, 70; all this is a matter of design choice for the specific application.

Varying fabrication and manufacturing techniques may be employed, if desired. For example, instead of making the footbed 40 and combined pads 60 and 70 of two separate parts, they could be formed integrally. Of course, if so formed, as by molding of the same material, the property of relative softness of the pads with respect to the footbed is a factor to be considered and compensated for as by selection of the specific molding formulation and configuration. Nonetheless, the footbed and pads could be formed integrally.

Extending this approach even further, the entire insert, comprising the footbed, combined pads and post, could be formed integrally. Again, however, if this were done, the feature of having the post made of the most resilient material would have to be taken into consideration in determining the configuration and material of the unitary insert. It should be borne in mind that the described and illustrated, three-part, preferred embodiment of FIGS. 1–13 achieves the optimum results of producing the desired functional cavus foot and consequent superior skiing operation, while doing so in the most comfortable manner.

Figure 14:
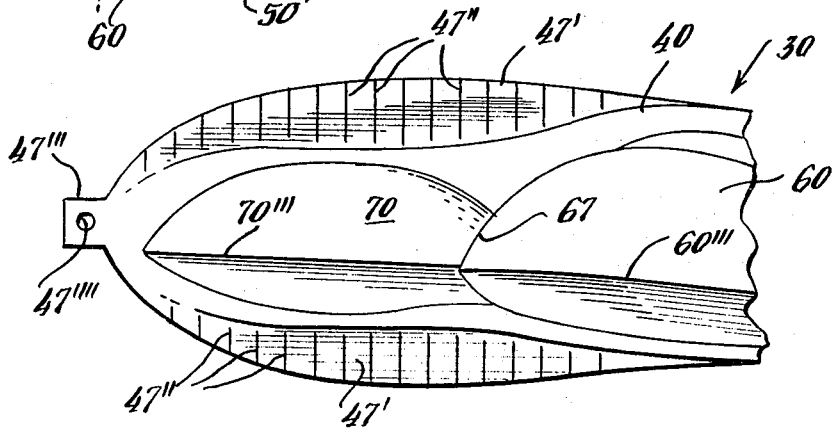
FIG. 14 is a view similar to FIG. 9 of the forward portion of a modified form of insert.

FIG. 14 illustrates a modification of the footbed wherein lateral slits 47″ are provided in the horizontal stabilizers 47′ to further facilitate flexing of the forward portion of the footbed and generally contribute to effective and comfortable operation, when an outer boot 12 of the illustrated type is used.

Another feature illustrated in FIG. 14 is the provision of a tab 47‴ which projects forwardly from the footbed and has an opening 47⁗. A pin or other retaining element may be carried by the ski boot and assembled in any convenient manner so as to extend through opening 47⁗ and prevent normal removal of an insert. This feature prevents the removal of an insert and its insertion into an improper ski boot.

Figure 16:
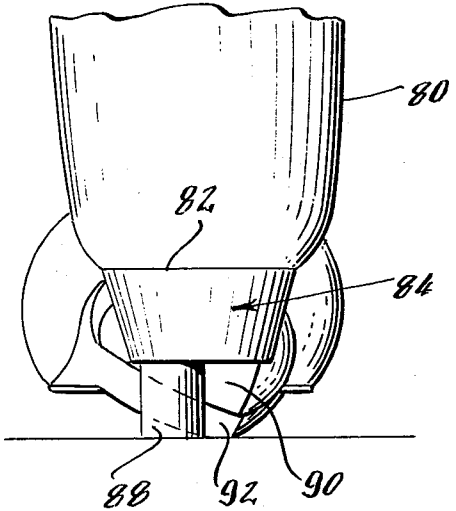
FIG. 16 is a rear elevational view of the FIG. 15 unit.
Figure 15:
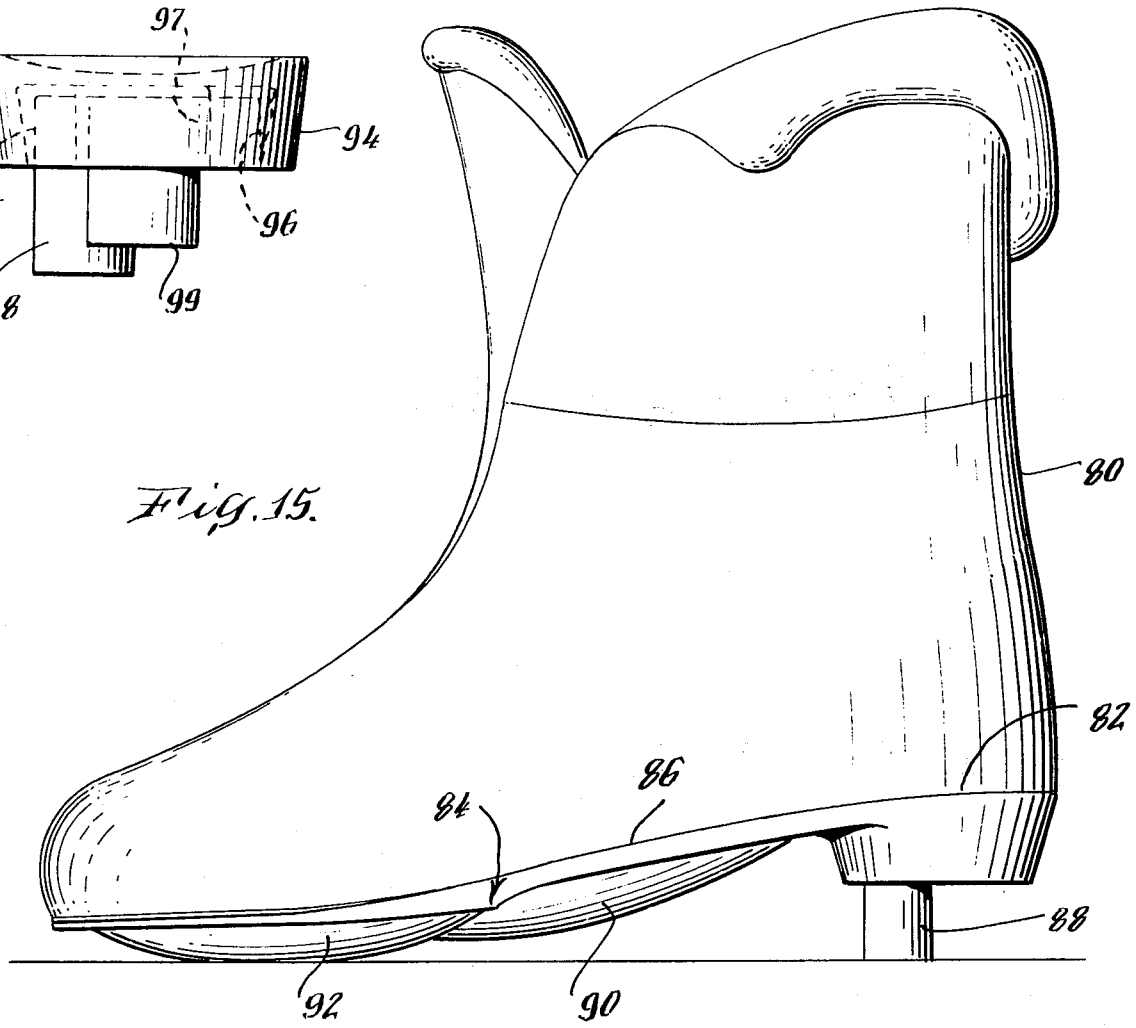
FIG. 15 is a side elevational view of an embodiment of the invention showing the insert and inner boot formed as a unit.

If desired, the insert 30 may be formed as an integral part of the inner boot 29. If this were done, centering of the insert in a ski boot would occur automatically. FIGS. 15 and 16 illustrate such an arrangement. An inner boot 80, which may take any convenient form known in the art, has a sole 82 to which is secured an insert 84 constructed in essentially the same manner as the insert 30 of FIGS. 9–12. In this regard, it includes a footbed portion 86 on the lower side of which is mounted: a laterally offset rear heel area balance post 88; a central metatarsal area balance pad 90, and a forward toe area balance pad 92. Any known manufacturing techniques may be employed to form the inner boot-insert unit illustrated in FIGS. 15 and 16. For example, the insert 84 may be formed separately, and then placed in an appropriate mold cavity and have the inner boot molded to it.

For illustrative purposes, an alternative method of manufacture would be to mold the insert and inner boot simultaneously and integrally of the same plastic material, such as a polymeric material. If this manufacturing approach is taken, it will be necessary to account for the loss of hardness differentials of the three-part embodiment in selecting the material and specific configuration of the insert. It will be necessary to provide a reinforcement means to provide the requisite stiffness in the sole portion between the central metatarsal balance area and the rear heel balance area.

A further manufacturing technique would be to form the insert separately and to secure it to a preformed inner boot, as by cementing, adhesion or the like. The specific method of manufacture may be any one known to those skilled in the plastic molding art and forms no specific part of my invention.

Figure 17:
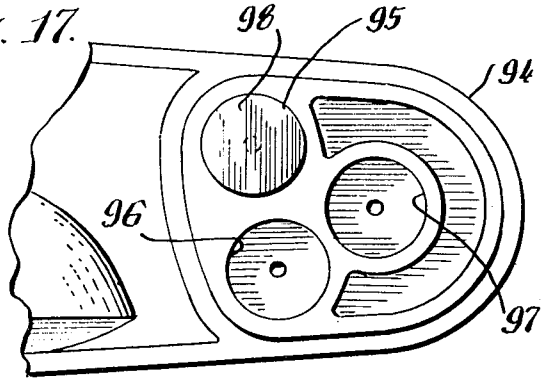
FIG. 17 is a bottom plan view of the heel portion of a modified insert.
Figure 18:
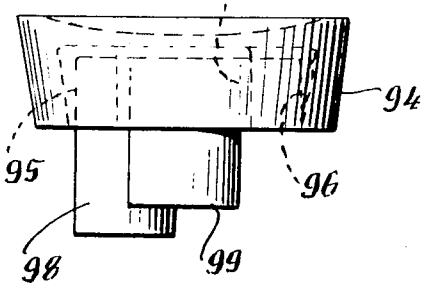
FIG. 18 is an end elevational view thereof.

FIGS. 17 and 18 illustrate a modified form of insert which may be optionally provided to enable a skier to select within a range of variations, more precisely the particular type of heel tilting motion and "feel" he desires. FIG. 17 shows the rear bottom portion of the modified insert including heel portion, which otherwise may be the same as the previously described inserts in other respects. The hollow heel 94 depends from the rear section of the insert footbed. Three hollow cylinders 95, 96 and 97 are formed within the outline of the heel and depend from the footbed. This enables the skier to have a variety of options as to the number and location of rear heel posts he desires to achieve the particular cushioning and tilting effect at the heel portion of the insert. The previously described inserts have been described as having their heel post located at the outboard side of the heel area. With the FIGS. 17 and 18 feature, a rear heel post 98 could be disposed in the outboard cylinder 95 and thereby effect the same arrangement and effect as the previously described insert. This is shown in FIG. 18 by positioning the post 98 in the cylinder 95. However, if desired, the post 98 could be selectively disposed in any one of the three cylinders 95, 96 and 97 to achieve different functional effects. Further, with reference to FIG. 18, if the post 98 is disposed in the outboard cylinder 95, a second post 99 could be mounted in the central cylinder 97. This would give a different functional effect in both cushioning and tilting. As illustrated in FIG. 18, the post 99 is shorter than the post 98. This introduces an additional variable which can be selectively made. It is possible to use only one, two or all three of the cylinders 95, 96 and 97 and to insert one, two or three posts and, if plural, of uniform or differing lengths. For this purpose, an insert constructed with the FIGS. 17 and 18 feature could be provided commercially with a plurality of posts of differing lengths and/or hardness to permit the skier to select the particular number, length, hardness and disposition of posts he finds most effective.

If desired to improve the comfort and/or function of any of my insert embodiments, various footbed contour changes of the top of the footbed, as by providing orthotics, may be made.

It should also be understood that though I have disclosed the part 30 of my invention as an "insert", it does not necessarily have to be a separate part from the boot, that is removable from the boot. Ingenious manufacturing techniques could be employed to form the insert with other parts of the boot so as not to be removable therefrom. My invention contemplates such an arrangement.

Further, my invention may be incorporated in ice sports shoes of other types than ski boots, such as cross-country ski boots, ice skates, and the like.

Regardless of the embodiment of my invention employed, it is the principal and distinguishing characteristic of my invention to provide an ice sports shoe, particularly a ski boot, that takes advantage of the natural structure and function of human feet, and causes the skier's feet desirably to assume functional cavus dispositions. This feet disposition is best for skiing, for example, because it is possible to get more distinct eversion of the feet and better pressuring of the inboard edges of the skis and consequentially better skiing control. The relative hardness of the pads and post permits soft tilting or pivoting motion of the footbed in response to everting and inverting the feet without any abrupt movements. The overall operation is comfortable to the skier, as his feet, though deformed to tend to approximate the cavus position, are supported by resilient cushioning means. Further, the lack of constriction of the feet and ankles, which are mounted for free selective inversion or eversion within the outer boot, permits good circulation of the blood in the skier's feet and avoids chilling, cramps and the like. My improved ski boots permit a skier to maneuver by using natural motions of the feet without requiring any substantial degree of knee bending or torso contortions. Ski boots made in accordance with my invention have in practice been tried by skiers of a variety of levels of proficiency with substantial unanimity of response being that the skiing is "easier", "more comfortable", "better controlled" and the like.

The above description of the invention and its applications is to be construed as illustrative only, rather than limiting. It will be apparent to those skilled in the art that various changes and modifications to the preferred embodiment described herein can be made without departing from the spirit and scope of the invention, which is limited only by the following claims.

I claim:

1. A ski boot for mounting on a foot of a skier, said ski boot comprising an outer boot having a substantially inflexible upper shell and a hole having an inside base; an insert disposed within said outer boot on said inside base in such a manner that it is capable of being laterally tiltable with respect to said outer boot upon inversion or eversion of the foot; and means for attaching said ski booth to a ski; said insert comprising a generally plate-like footbed for supporting the foot of a skier, said footbed being configured and made of a flexible material so as to form and hold the skier's foot in a functional cavus position when the foot is placed thereon; said insert having a rear heel area balance means disposed at a lower surface at one end and a front toe area balance means disposed at said lower surface opposite said rear balance means, both of said balance means contacting said inside base when said insert is operatively in place, whereby in operation, upon a relatively minor eversion of the skier's foot, said insert tilts and applies pressure on the inboard edge of the ski to which said boot is attached.

2. A ski boot as defined in claim 1 wherein said footbed is formed with a relatively weakened flexure zone in the vicinity of where the skier's metatarsal area is disposed when the ski boot is operatively mounted on the skier's foot so as to facilitate the formation of the cavus foot configuration.

3. A ski boot as defined in claim 2 wherein the thickness of the footbed from the weakened zone forwardly is less than that from the weakened zone rearwardly.

4. A ski boot as defined in claim 1 wherein the thickness of the footbed section from the metatarsal area forwardly is less than that of the section from the metatarsal area rearwardly to facilitate the formation of the cavus foot.

5. A ski boot as defined in claim 1 wherein said front toe area balance means comprises a pad having a depending ridge disposed so as to be offset inboard of the centerline of said footbed when the ski boot is in operative position.

6. A ski boot as defined in claim 1 wherein said rear heel area balance means is disposed so as to be laterally offset outboard of the centerline of said footbed when the ski boot is in operative position.

7. A ski boot as defined in claim 1 wherein said front toe area balance means is made of a material that is softer than the material of said footbed, and harder than the material of said rear heel area balance means.

8. A ski boot as defined in claim 1 wherein said insert includes a metatarsal area balance means disposed intermediate the ends of said insert in position to contact said inside base when the ski boot is operatively mounted on the foot of a skier.

9. A ski boot as defined in claim 8 wherein said front toe area balance means comprises a pad having a depending ridge disposed so as to be offset inboard of the centerline of said footbed when the ski boot is in operative position, and said metatarsal area balance means comprises a pad generally similarly configured to the pad that forms said front toe area balance means.

10. A ski boot as defined in claim 7 wherein said insert includes a metatarsal area balance means disposed intermediate the ends of said insert in position to contact said inside base when the ski boot is operatively mounted on the foot of a skier, and said metatarsal area balance means is made of a material having similar hardness characteristics to that of said front toe area balance means.

11. A ski boot as defined in claim 8 wherein said front toe area balance means comprises a pad having a depending ridge disposed so as to be offset inboard of the centerline of said footbed when the ski boot is in operative position, and said metatarsal area balance means comprises a pad generally similarly configured to the pad that forms said front toe area balance means, both of said toe area balancing means and metatarsal area balancing means being made of a single part that is secured to the underside of said footbed.

12. A ski boot as defined in claim 9 wherein said rear heel area balance means comprises a post which depends from the heel portion of said footbed and is disposed so as to be offset laterally outboard of the centerline of said footbed.

13. A ski boot as defined in claim 8 wherein said front toe area balance means comprises a pad having a depending ridge disposed so as to be offset inboard of the centerline of said footbed when the ski boot is in operative position, and said metatarsal area balance means comprises a pad generally similarly configured to the pad that forms said front toe area balance means, both of said toe area balance means and metatarsal area balance means having their depending ridges aligned and disposed so as to be offset inboard of the centerline of said footbed.

14. A ski boot as defined in claim 13 wherein said rear heel area balance means comprises a post which depends from the heel portion of said footbed and is disposed so as to be offset laterally outboard of the centerline of said footbed.

15. A ski boot as defined in claim 1 wherein a plurality of sockets is formed in the heel portion of said footbed arranged selectively to receive one or more heel area balance means in the form of posts.

16. A ski boot comprising an outer boot having a substantially inflexible upper shell and a sole having an inside base; an insert disposed within said outer boot on said inside base in such a manner that it is capable of being laterally tiltable with respect to said outer boot upon inversion or eversion of the foot; and means for attaching said ski boot to a ski; said insert comprising a generally plate-like footbed for supporting the foot of a skier, said footbed being configured and made of a flexible material so as to form and hold the skier's foot in a functional cavus position when the foot is placed thereon; said insert having a rear heel area balance means disposed at a lower surface at one end and a front toe area balance means disposed at said lower surface opposite said rear balance means, both of said balance means contacting said inside base when said insert is operatively in place, said toe area balance means comprising a pad having a depending ridge; a metatarsal area balance means in the form of a metatarsal pad disposed on the underside of said footbed intermediate its ends, said metatarsal pad generally similarly configured to the pad that forms said toe area balance means; the ridges of said pads being laterally offset inboard of the centerline of said footbed; and said rear heel area balance means comprising a post that is disposed to be laterally offset outboard of said footbed.

17. A ski boot as defined in claim 16 wherein each of said pads has two sidewall surfaces which form said ridges, the wall surfaces on the outboard side of said footbed having a more gradual slope than those on the inboard side.

18. A ski boot as defined in claim 16 wherein said footbed is made of a strong flexible material; said post is made of soft resilient material and said pads are made of a material that is slightly softer than that of said footbed and substantially harder than that of said post.

19. A ski boot as defined in claim 16 wherein said footbed is made of a moldable polymer having a hardness durometer of Shore D, 58–63; said post is made of a natural or synthetic rubber having a hardness durometer of Shore A, 43–47; and said pads are made of a closed cell urethane foam having a hardness durometer of Shore A, 55–60.

20. A ski boot as defined in claim 16 wherein said pads are formed in one part that is secured to said footbed.

21. A ski boot as defined in claim 16 wherein said pads are configured to form a weakened zone in the area of juncture of said pads whereby said insert is relatively more flexible at the said area.

22. A ski boot as defined in claim 21 wherein said pads are formed by one part and said weakened zone is formed by a reduced thickness portion of said part.

23. A ski boot as defined in claim 16 wherein said footbed and said pads are formed in one part.

24. A ski boot as defined in claim 16 wherein said footbed, said pads and said post are formed in one part.

25. A ski boot as defined in claim 16 wherein spaced side portions of said footbed on opposite lateral sides of said toe area balancing means pad are of reduced thickness to form horizontal stabilizers which aid in positioning said insert in said outer boot.

26. A ski boot as defined in claim 25 wherein a plurality of lateral slits are formed in said stabilizers.

27. A ski boot as defined in claim 16 wherein said pads are formed of a single part and joined by a weakened flexure zone, each pad has two sidewall surfaces which form said ridges, the wall surfaces on the outboard side have a more gradual slope than those on the inboard side, and said ridges are aligned and extend rearwardly toward the inboard side.

28. A ski boot as defined in claim 27 wherein said footbed is made of a strong flexible material; said post is made of a soft resilient material and said pads are made of a material that is slightly softer than that of said footbed and substantially harder than that of said post.

29. A ski boot as defined in claim 27 wherein said footbed is made of a moldable polymer having a hardness durometer of Shore D, 58–63; said post is made of a natural or synthetic rubber having a hardness durometer of Shore A, 43–47; and said pads are made of a closed cell urethane foam having a hardness durometer of Shore A, 55–60.

30. A ski boot as defined in claim 16 wherein said insert includes means for locking it in said outer boot.

31. A ski boot as defined in claim 16 which further includes an inner boot, said insert and said inner boot being formed as a unit.

32. An insert for use with an ice sports shoe having a sole, such as a ski boot or an ice skate, said insert comprising a foot supporting plate-like footbed arranged to support the user's foot, said insert being shaped so as to laterally tiltably fit inside the shoe and rest upon the sole, said insert having means arranged to permit lateral tilting of the insert with respect to the sole upon inversion or eversion of the user's foot when said insert is in place inside the shoe comprising a rear heel balance post disposed at the lower surface at one end of said footbed and a front toe area balance pad disposed at said lower surface at the end opposite said rear balance post, said pad having two side surfaces which form a depending ridge that extends rearwardly of said footbed, said footbed being configured and made of a flexible material so as to form and hold the user's foot in a functional cavus position when the foot is placed thereon.

33. An insert as defined in claim 32 wherein said insert includes a metatarsal balance pad disposed intermediate the ends of said insert in position to contact the sole when the shoe is operationally mounted on the foot of a user, said metatarsal pad being generally similarly configured as said toe area balancing pad.

34. An insert as defined in claim 33 wherein said pads are formed in one part that is secured to said footbed.

35. An insert as defined in claim 33 wherein said pads have an adjacent area and are configured to form a weakened zone in said area whereby said insert is relatively more flexible at the said area.

36. An insert as defined in claim 33 wherein said pads have an adjacent area and said footbed is thicker in its portion that extends rearwardly from said area.

37. An insert as defined in claim 33 wherein said footbed is made of a strong flexible material; said post is made of a soft resilient material and said pads are made of a material that is slightly softer than that of said footbed and substantially harder than that of said post.

38. An insert as defined in claim 33 wherein said footbed is made of a moldable polymer having a hardness durometer of Shore D, 58–63; said post is made of a natural or synthetic rubber having a hardness durometer of Shore A, 43–47; and said pads are made of a closed cell urethane foam having a hardness durometer of Shore A, 55–60.

39. An insert as defined in claim 32 wherein said post is disposed on the lateral offset outboard side of said footbed, and said ridge is disposed on the inboard side of said footbed.

40. An insert for use with an ice sports shoe having a sole, such as a ski boot or an ice skate, said insert comprising a foot supporting plate-like footbed arranged to support the user's foot, said insert being shaped so as to be able to laterally tiltably fit inside the shoe and rest upon the sole, said insert having means arranged to permit lateral tilting of the insert with respect to the sole upon inversion or eversion of the user's foot when said insert is in place inside the shoe comprising a rear heel area balance post disposed at the lower surface at one end of said footbed on the laterally offset outboard side thereof, a front toe area balance pad disposed at said lower surface at the end opposite said rear heel area balance post, and a metatarsal area balance pad disposed intermediate the ends of said insert in position to contact the sole when the shoe is operationally mounted on the foot of the user, said toe area balance pad and said metatarsal area balance pad comprising generally similarly configured mound-like formations which depend from the underside of said footbed, each of which is formed by two side surfaces that intersect to form a depending ridge that extends rearwardly at the inboard side of said footbed and which ridges are aligned, the side surfaces of said pads which are located on the outboard side of said footbed having slope angles that are more gradual than the slope angles of the sides of the surfaces of said pads which are located on the inboard side of said footbed, said pads being formed in one part that is secured to the underside of said footbed, said pads being configured to form a weakened footbed zone in the area of their juncture whereby said insert is relatively more flexible at the said area, the portion of said footbed that extends rearwardly from the said relatively more flexible area being thicker than that which extends forwardly thereof, said footbed being made of a strong flexible material, said post being made of a soft resilient material and said pads being made of material that is slightly softer than that of said footbed and substantially harder than that of said post.

41. An insert as defined in claim 40 wherein said footbed is made of a moldable polymer having a hardness durometer of Shore D, 58–63; said post is made of a natural or synthetic rubber having a hardness durometer of Shore A, 43–47; and said pads are made of a closed cell urethane foam having a hardness durometer of Shore A, 55–60.

* * * * *

UNITED STATES PATENT AND TRADEMARK OFFICE

CERTIFICATE OF CORRECTION

PATENT NO. : 4,253,252

DATED : March 3, 1981

INVENTOR(S) : Joel H. Eisenberg

It is certified that error appears in the above-identified patent and that said Letters Patent are hereby corrected as shown below:

Column 5, line 29, "size." should be --size,--.

Column 9, line 67, after "will" insert --also--.

Column 10, line 14, after "including" insert --a modified--.

Column 11, line 31, "hole" should be --sole--.

Column 11, line 38, "booth" should be --boot--.

Column 13, line 31, after "of" (first occurrence)insert -- a --.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*